US010745781B2

(12) United States Patent
Muralidharan et al.

(10) Patent No.: US 10,745,781 B2
(45) **Date of Patent: *Aug. 18, 2020**

(54) ALUMINA-FORMING, HIGH TEMPERATURE CREEP RESISTANT NI-BASED ALLOYS

(71) Applicant: UT-BATTELLE, LLC, Oak Ridge, TN (US)

(72) Inventors: Govindarajan Muralidharan, Knoxville, TN (US); Bruce A. Pint, Knoxville, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/188,253

(22) Filed: Nov. 12, 2018

(65) Prior Publication Data

US 2019/0169714 A1 Jun. 6, 2019

Related U.S. Application Data

(63) Continuation of application No. 14/745,740, filed on Jun. 22, 2015, now Pat. No. 10,174,408.

(51) Int. Cl.
*C22C 19/05* (2006.01)

(52) U.S. Cl.
CPC ..... *C22C 19/056* (2013.01); *C22C 19/057* (2013.01)

(58) Field of Classification Search
CPC ... C22C 19/055; C22C 19/056; C22C 19/057; C22F 1/10
See application file for complete search history.

(56) References Cited

U.S. PATENT DOCUMENTS

| | | | | |
|---|---|---|---|---|
| 4,204,862 | A | 5/1980 | Kado et al. | |
| 4,209,348 | A | 6/1980 | Duhl et al. | |
| 7,285,337 | B2 | 10/2007 | Narita et al. | |
| 7,744,813 | B2 | 6/2010 | Brady et al. | |
| 10,174,408 | B2 * | 1/2019 | Muralidharan | C22C 19/057 |
| 2003/0005981 | A1 | 1/2003 | Ogawa et al. | |
| 2005/0271886 | A1 | 12/2005 | Cetel | |
| 2013/0266477 | A1 | 10/2013 | Yamamoto et al. | |

FOREIGN PATENT DOCUMENTS

| | | | |
|---|---|---|---|
| CN | 101538664 | A | 9/2009 |
| JP | 2002332563 | A | 11/2002 |

OTHER PUBLICATIONS

Prescott, R and M.J. Graham, "The Formation of Aluminum Oxide Scales on High-Temperature Alloys," Oxidation of Metals, 1992, pp. 233-254, vol. 38, Nos. 3/4.

Rashid, A.K.M.B. and J. Campbell, "Oxide Defectsin a Vacuum Investment-Cast Ni-Based Turbine Blade," Metallurgical and Materials Transactions A, 2004, pp. 2063-2071, vol. 35, Issue 7.

* cited by examiner

*Primary Examiner* — Jessee R Roe
(74) *Attorney, Agent, or Firm* — Fox Rothschild LLP

(57) ABSTRACT

An alumina-forming, high temperature creep resistant alloy is composed essentially of, in terms of weight percent: up to 10 Fe, 3.3 to 4.6 Al, 6 to 22 Cr, 0.68 to 0.74 Mn, 5.2 to 6.6 Mo, 0.4 to 1.2 Ti, up to 0.1 Hf, 0.005 to 0.05 La, 0.4 to 0.6 W, 0.1 to 0.35 C, up to 0.002 B, 0.001 to 0.02 N, balance Ni.

19 Claims, 18 Drawing Sheets

ALUMINA-FORMING, HIGH TEMPERATURE CREEP RESISTANT NI-BASED ALLOYS

CROSS REFERENCE TO RELATED APPLICATIONS

This U.S. Patent Application is a Continuation Application of U.S. patent application Ser. No. 14/745,740 filed on Jun. 22, 2015, entitled "Alumina-Forming, High Temperature Creep Resistant Ni-Based Alloys", the entirety of which is incorporated herein by reference.

STATEMENT REGARDING FEDERALLY SPONSORED RESEARCH

The United States Government has rights in this invention pursuant to contract no. DE-AC05-00OR22725 between the United States Department of Energy and UT-Battelle, LLC.

BACKGROUND OF THE INVENTION

Much effort has been made toward the development of a wrought, Ni-base high-temperature alloy for turbine applications such as combustor liners, with limited success. For example Haynes alloy HR230® has a creep strength of 1000 hours at 1100° C., but its oxidation resistance is limited because it forms a chromia scale at high temperatures. Rapid formation of chromia leads to thick oxides which spall and cannot achieve the required lifetimes. Furthermore, chromia reacts with oxygen and water vapor above 600° C. to form a volatile reaction product ($CrO_2(OH)_2$ which increases the rate of degradation in most combustion environments. For example, the combustor liner on a small turbine needs to operate for 25,000-40,000 h at high temperature before the first major overhaul.

Moreover, Haynes alloy HR214® and Haynes alloy HR224® have oxidation resistance associate with the formation of alumina scales at temperatures up to 1100° and 1000° C., respectively. However, these alloys may not have sufficient phase stability or creep strength for some high temperature applications. Use of alumina- or chromia-forming Ni-base alloys requires trade-off in alloy properties. Other potential applications are concentrated solar power receivers and heat exchangers. Wrought alloys are desirable wherever sheet material is needed for applications such as combustor liners and associated hot gas paths in turbines and other high temperature applications. Heat exchanger applications could include primary surface recuperators and/or heat exchangers where the wall thickness may only be 50-250 μm. In this case, the alloy must possess both creep and oxidation resistance for applications that have operating temperatures in the range of 800° to at least 1100° C.

BRIEF SUMMARY OF THE INVENTION

In accordance with one aspect of the present invention, the foregoing and other objects are achieved by an alumina-forming, high temperature creep resistant alloy that is composed essentially of, in terms of weight percent: up to 10 Fe, 3.3 to 4.6 Al, 6 to 22 Cr, 0.68 to 0.74 Mn, 5.2 to 6.6 Mo, 0.4 to 1.2 Ti, up to 0.1 Hf, 0.005 to 0.05 La, 0.4 to 0.6 W, 0.1 to 0.35 C, up to 0.002 B, 0.001 to 0.02 N, balance Ni.

In accordance with another aspect of the present invention, the foregoing and other objects are achieved by an alumina-forming, high temperature creep resistant alloy that is composed essentially of, in terms of weight percent: 9.4 to 10 Fe, 3.6 to 4.2 Al, 16 to 17 Cr, 0.68 to 0.74 Mn, 5.2 to 5.4 Mo, 0.45 to 0.5 Ti, 0.005 to 0.05 La, 0.4 to 0.6 W, 0.1 to 0.35 C, up to 0.002 B, 0.001 to 0.02 N, balance Ni.

In accordance with a further aspect of the present invention, the foregoing and other objects are achieved by an alumina-forming, high temperature creep resistant alloy that is composed essentially of, in terms of weight percent: 1.8 to 2.2 Fe, 3.3 to 4.0 Al, 17 to 20 Cr, 0.68 to 0.74 Mn, 6.0 to 6.6 Mo, 0.4 to 0.6 Ti, 0.06 to 0.1 Hf, 0.005 to 0.05 La, 0.4 to 0.6 W, 0.1 to 0.35 C, up to 0.002 B, 0.001 to 0.02 N, balance Ni.

Figure 1:
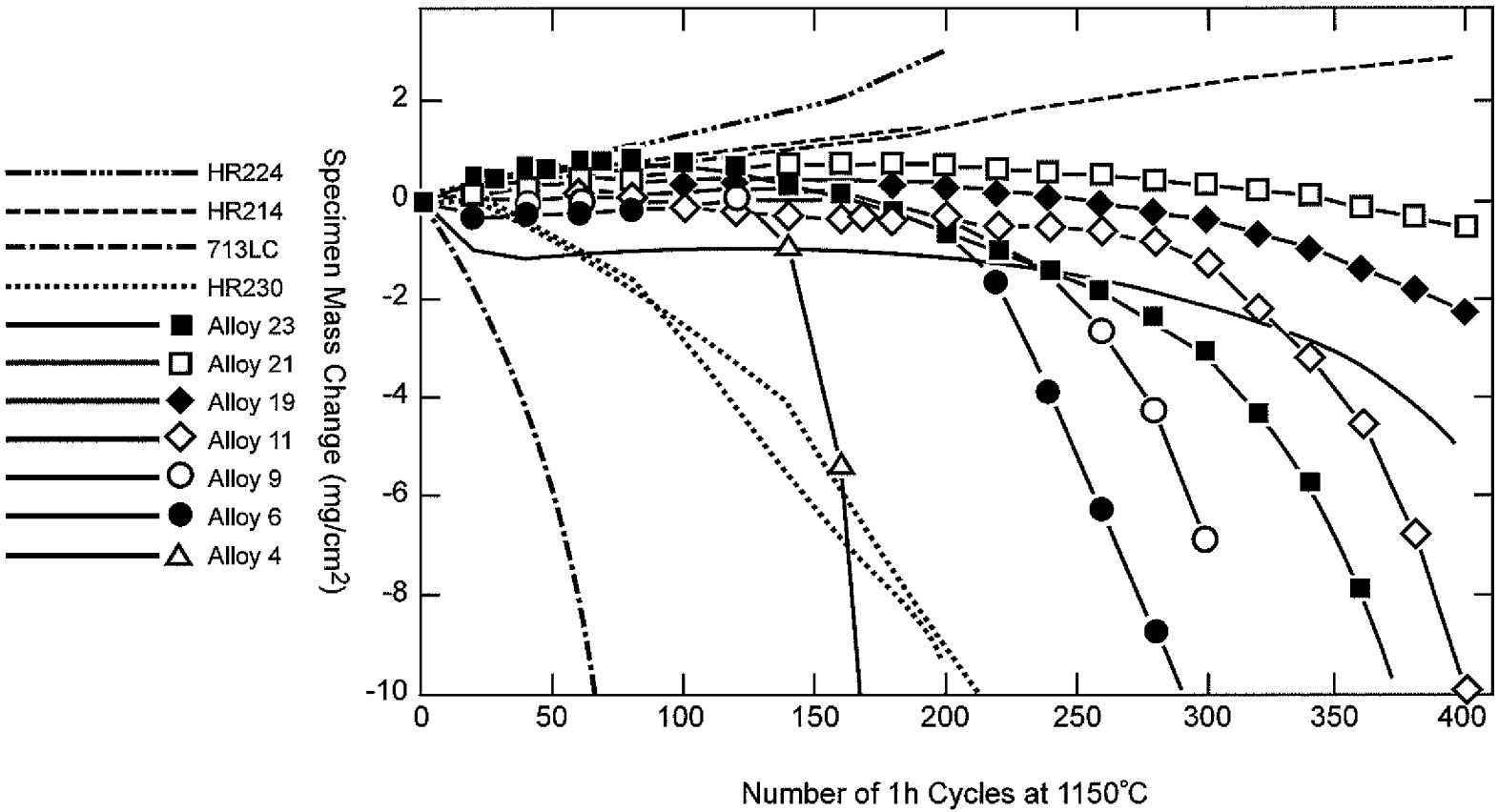
FIG. 1 is a graph showing mass change for various Ni-base alloys exposed in wet air at 1150° C. with 1 hour cycles.

For a better understanding of the present invention, together with other and further objects, advantages and capabilities thereof, reference is made to the following disclosure and appended claims in connection with the above-described drawings.

DETAILED DESCRIPTION OF THE INVENTION

An alumina forming alloy (AFA) was sought because AFAs have a lower corrosion rates than chromia forming alloys (CFAs) due to a slower growing, thin, adherent oxide. An AFA is needed that has a suitable combination of creep strength and oxidation resistance in order to enable applicability in operating temperatures in the range of 800° to at least 1100° C., and/or allow use of a component having a reduced thickness.

Elements are selected for the alloys based on, but not always strictly following the following general guidance.

Nickel: Primary constituent; certain amount of nickel is required to achieve beneficial strength, and ductility properties. Higher the temperature of operation, greater is the amount of Ni generally required.

Aluminum: Forms external, protective alumina scale, providing the foundation of oxidation resistance. Insufficient Al content can result in internal oxidation and poor oxidation resistance. Too much Al can lead to problems with phase stability, ductility, welding and mechanical properties.

Iron: Minimizes cost of alloy. Provides solid solution strengthening. Too much iron can destabilize austenitic matrix and degrade the oxidation resistance. Further to the description above, iron can be present in an amount of 1 to 6 wt. %. Moreover, iron can be present in an amount of 0.1 to 2 wt. %.

Chromium: Ensures good oxidation resistance by supporting the formation of an external alumina scale but limited to 22 wt. %. Too much chromium may result in formation of undesirable BCC phase or other brittle intermetallics. Moreover, chromium can be present in an amount of 16 to 20 wt. %.

Manganese: Stabilizes the austenitic matrix phase. Provides solid solution strengthening.

Molybdenum: Added for solid solution strengthening, also is the primary constituent in $M_6C$ carbides. Decreases average interdiffusion coefficient. Too much addition can result in the formation of undesirable, brittle intermetallic phases and can reduce oxidation resistance Titanium: Provides primary strengthening through the formation of γ' precipitates. Ratio of aluminum to Ti changes the high temperature stability of the γ' precipitates, strengthening achievable for an average precipitate size, and the anti-phase boundary (APB) energy. Too much Ti can degrade oxidation resistance.

Hafnium: Reduces the growth rate and improves the adhesion of the external alumina-scale with maximum beneficial effect when added in conjunction with a rare earth addition with high S affinity such as La or Y. Also assists with the formation of stable carbides for strengthening.

Lanthanum: Reduces the growth rate and improves the adhesion of the external alumina-scale Adhesion of the oxide is extremely important for long term applications. The continual growth and spallation of an alumina scale will eventually lead to Al depletion from the component and premature failure. High levels of La can result in excessive internal oxidation. An optimal La addition is generally 2-10× the S content (when compared in at %).

Tungsten: Provides solid solution strengthening and decreases average interdiffusion coefficient. Too much can result in the formation of brittle intermetallic phases.

Carbon, Nitrogen: Required for the formation of carbide and carbonitride phases that can act as grain boundary pinning agents to minimize grain growth and to provide resistance to grain boundary sliding. Fine precipitation of carbides and carbonitrides can increase high temperature strength and creep resistance.

It is important to have sufficient Al+Cr in order to obtain the desired oxidation resistance. Lower Cr levels will typically, but not always require higher Al levels.

Example

Alloy test samples having compositions shown in Table 1 were arc-cast, rolled, solution annealed at 1150° C., and water quenched using well-known, conventional techniques.

The test samples were subjected to standard oxidation resistance testing along with commercially available Haynes alloys HR214®, HR224®, and HR230® for comparison. In one test, 1-hour cycles at 1150° C. in wet air (10% $H_2O$) to simulate a turbine environment. In the test, low mass gains are ideal, reflecting the formation of a thin protective surface oxide. Mass loss suggests that a surface oxide formed and then spalled off during thermal cycling; large mass loss suggests that a thicker surface oxide repeatedly formed and spalled off. Test results are shown in FIG. 1.

Alloy samples 11, 19, 21, and 23 all out-performed an earlier alloy series (alloys 1, 4, 6, and 9) reflecting the composition modifications. Note that HR230® shows a significant mass loss during this aggressive test and commercial NiCrAl alloys HR214®, HR224® begin to gain mass at a higher rate due to the conditions.

Figure 2:
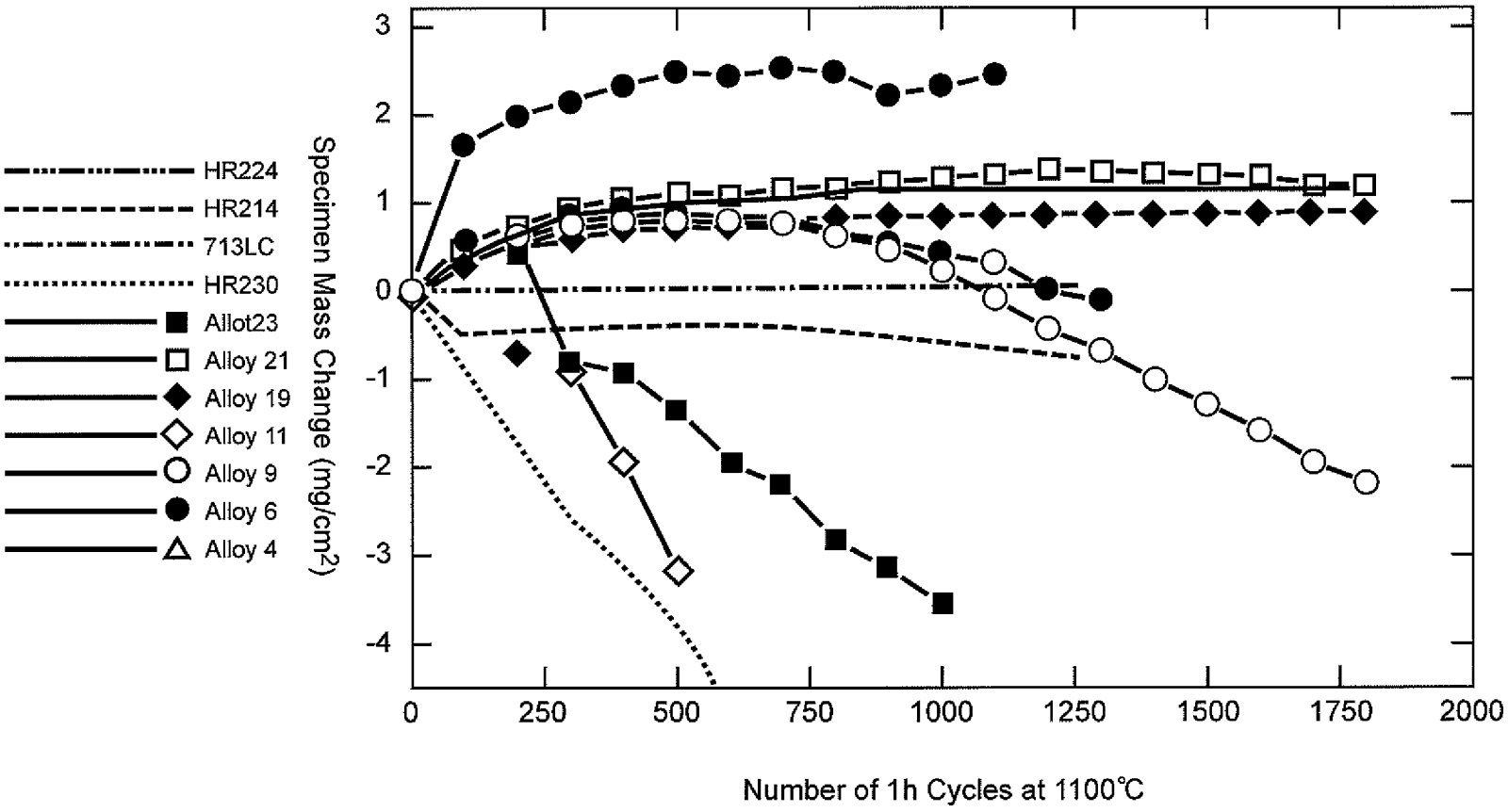
FIG. 2 is a graph showing mass change for various Ni-base alloys exposed in wet air at 1100° C. with 100 hour cycles.
Figure 3:
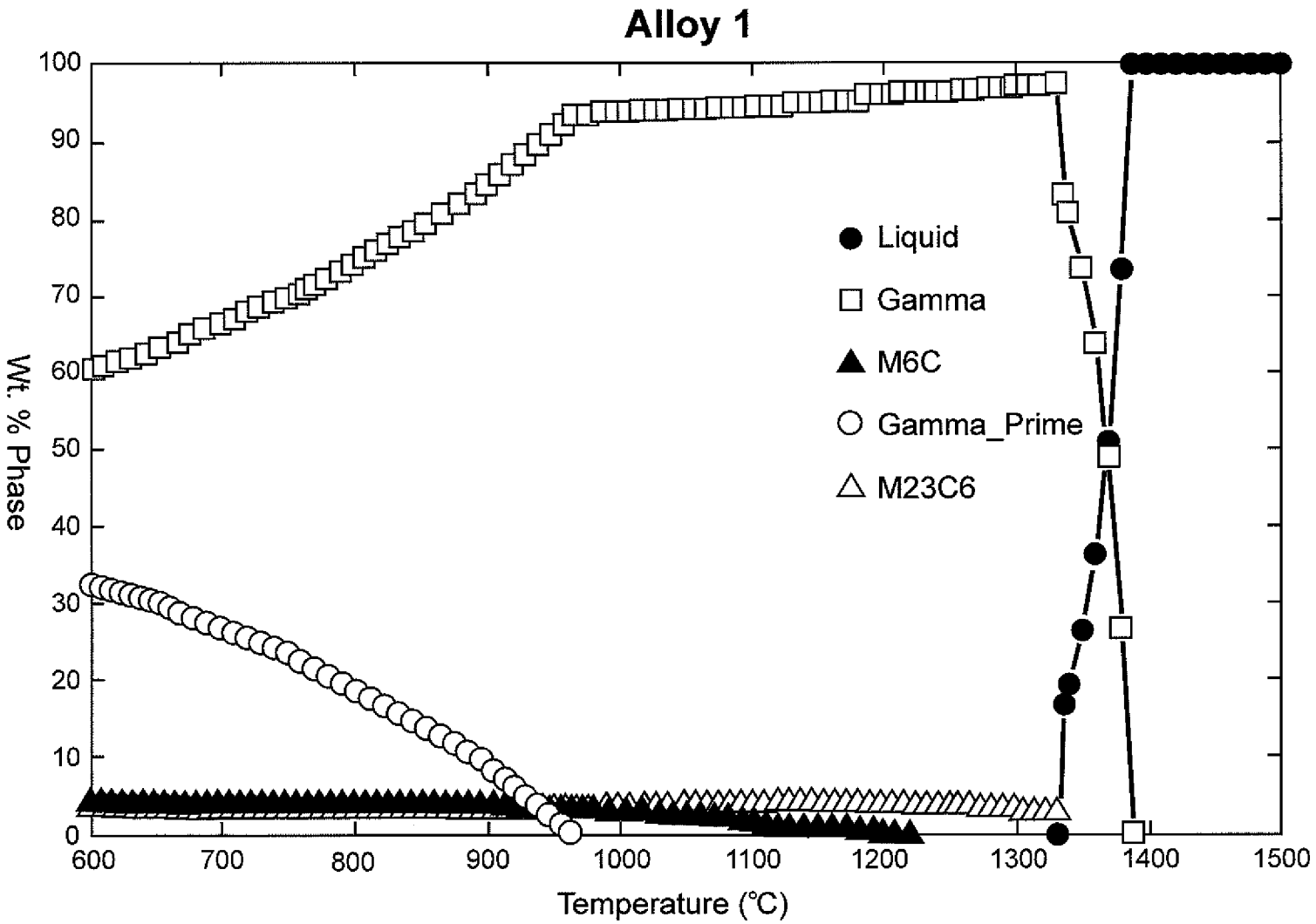
FIG. 3 is a graph showing phase equilibria for Alloy 1 as a function of temperature (nitrogen and boron are not included in the calculations).
Figure 4:
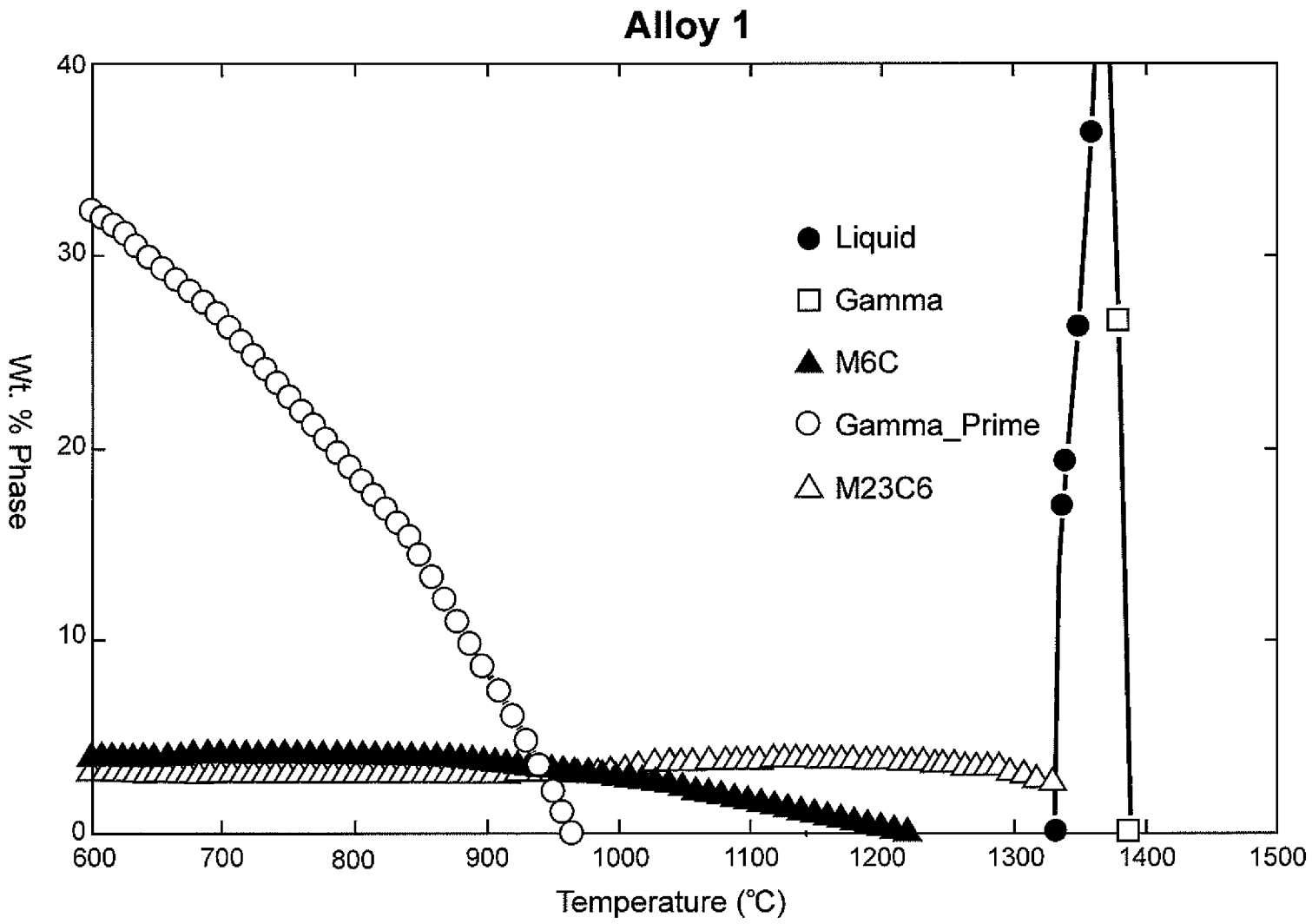
FIG. 4 is an expanded view of a portion of the graph shown in FIG. 3 to show details.
Figure 5:
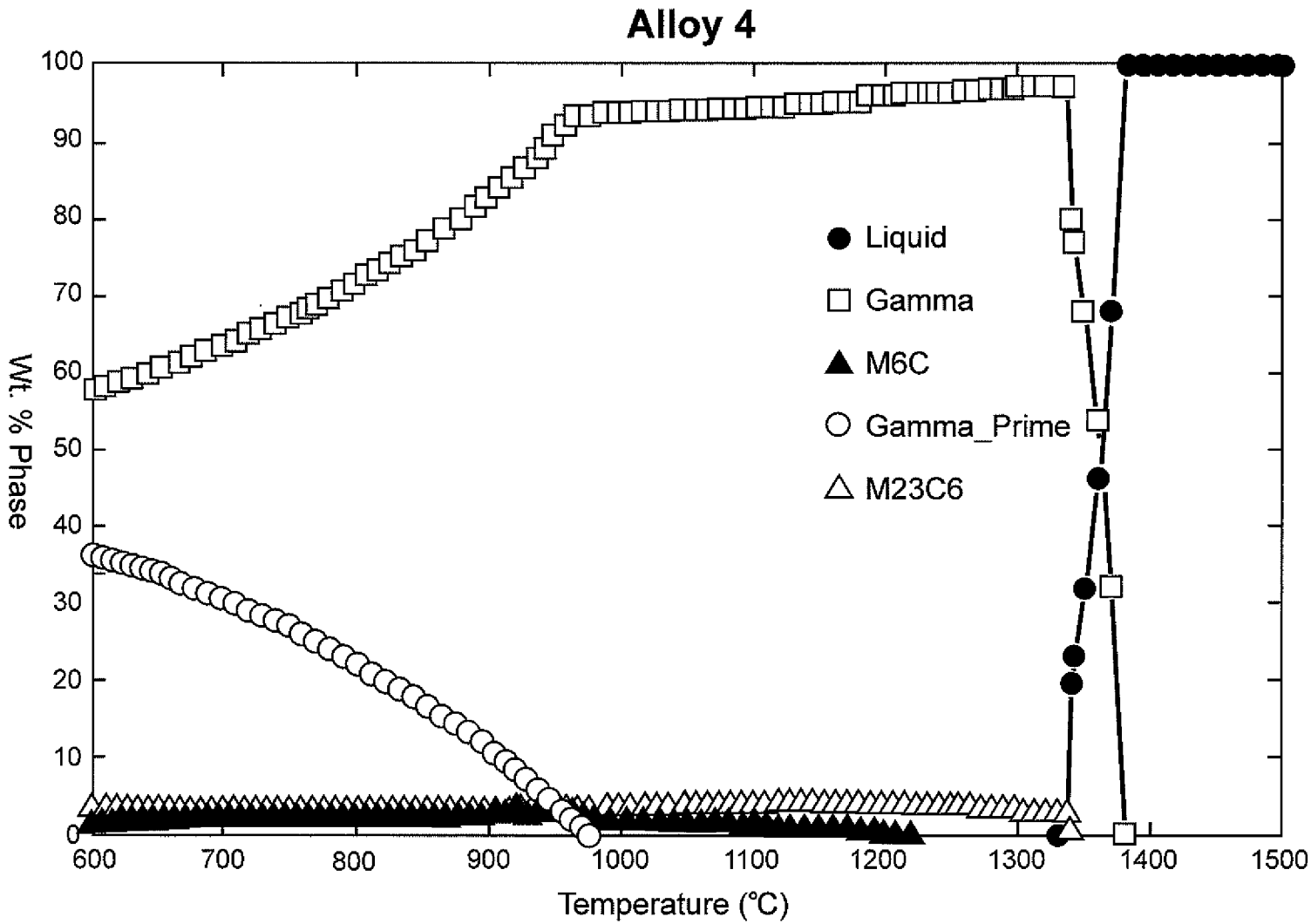
FIG. 5 is a graph showing phase equilibria for Alloy 4 as a function of temperature (nitrogen and boron are not included in the calculations).
Figure 6:
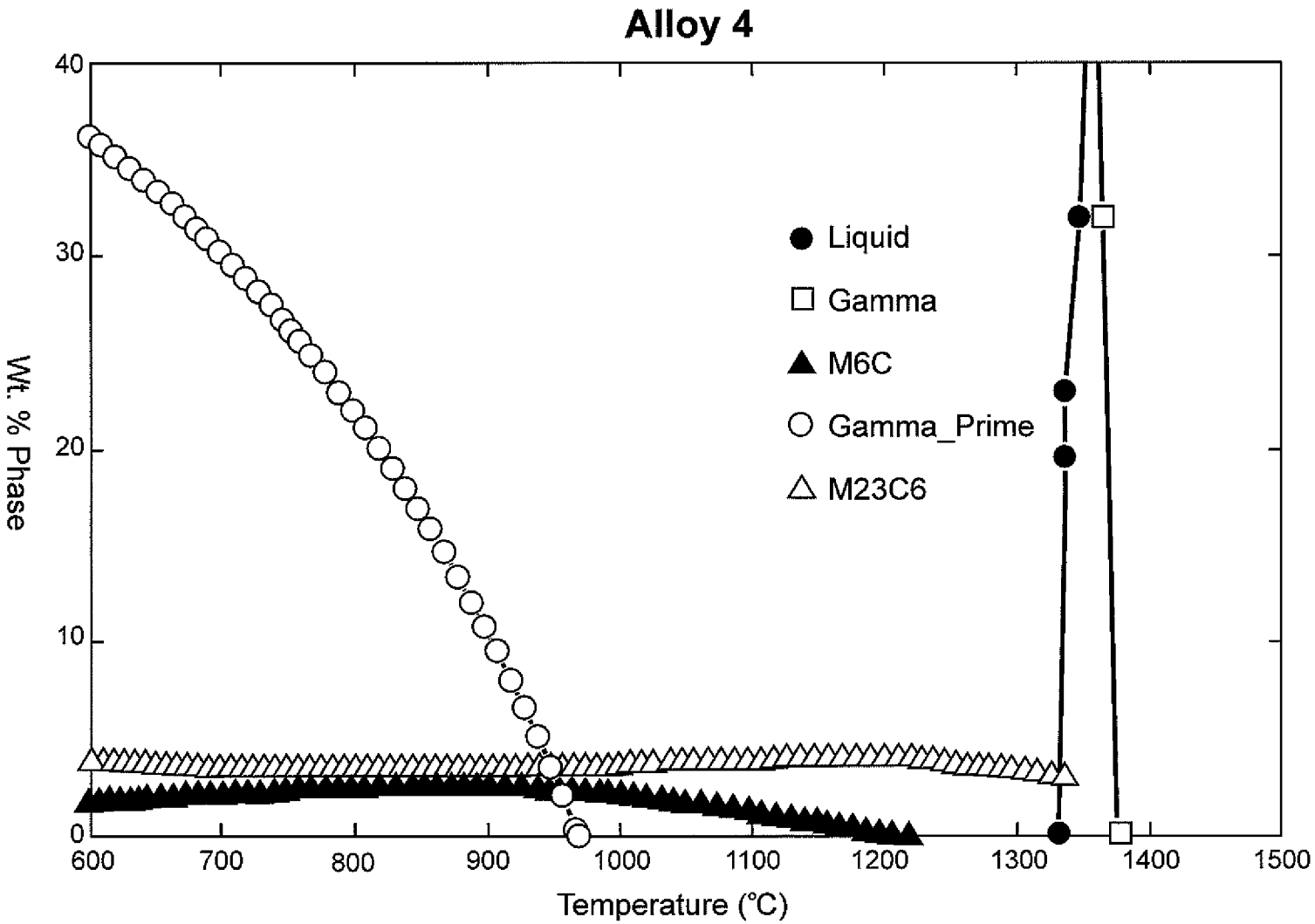
FIG. 6 is an expanded view of a portion of the graph shown in FIG. 5 to show details.
Figure 7:
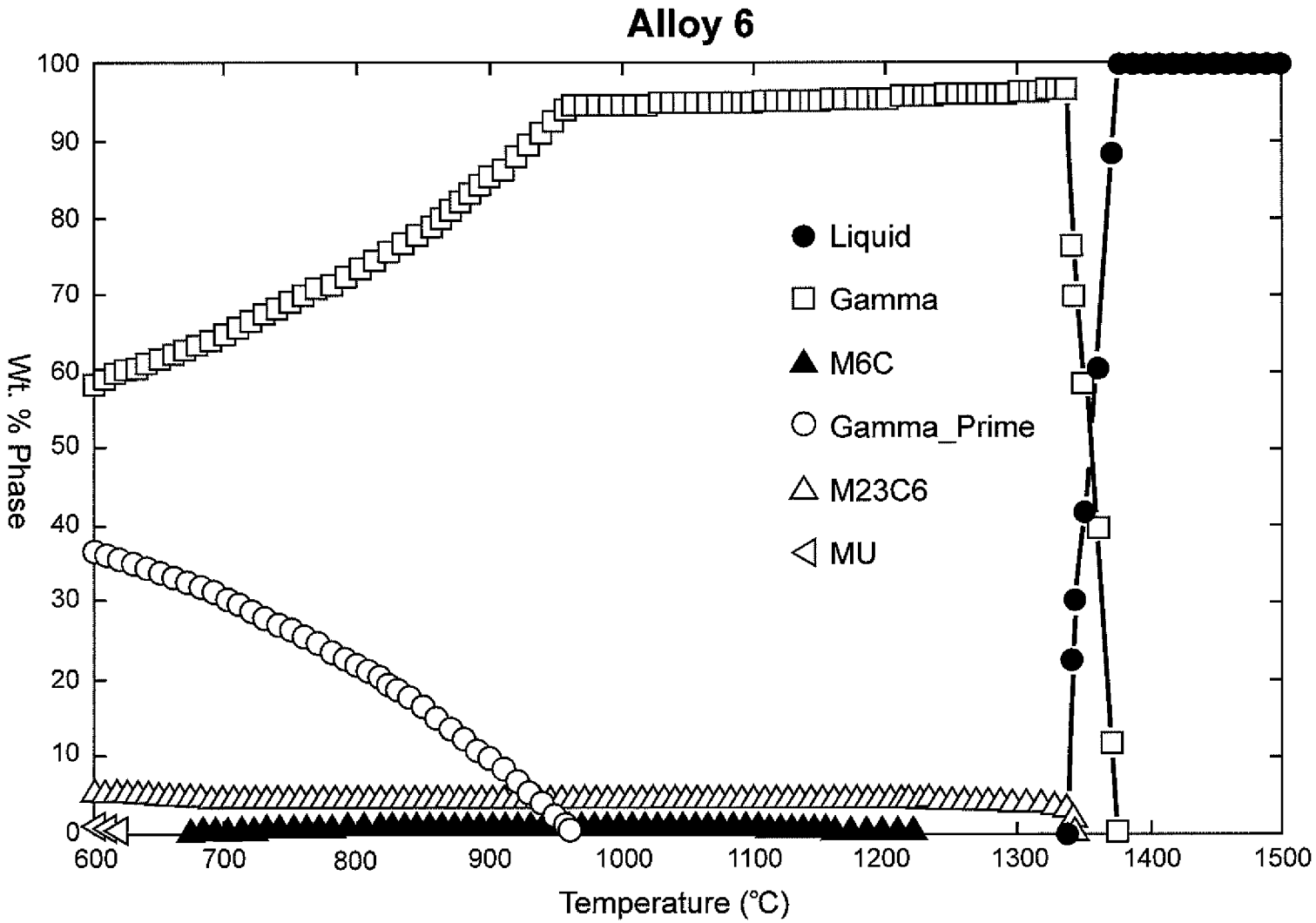
FIG. 7 is a graph showing phase equilibria for Alloy 6 as a function of temperature (nitrogen and boron are not included in the calculations).
Figure 8:
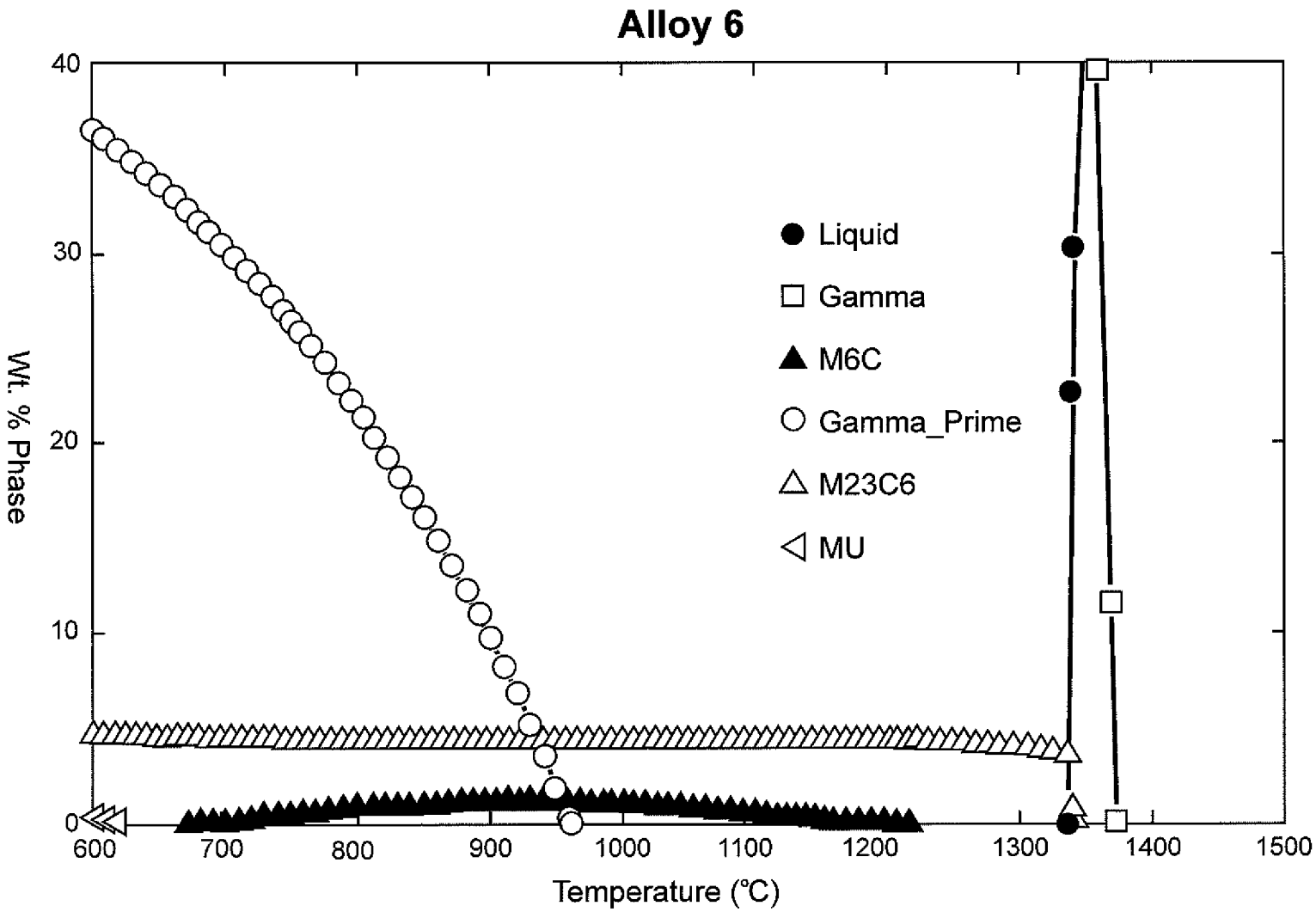
FIG. 8 is an expanded view of a portion of the graph shown in FIG. 7 to show details.
Figure 9:
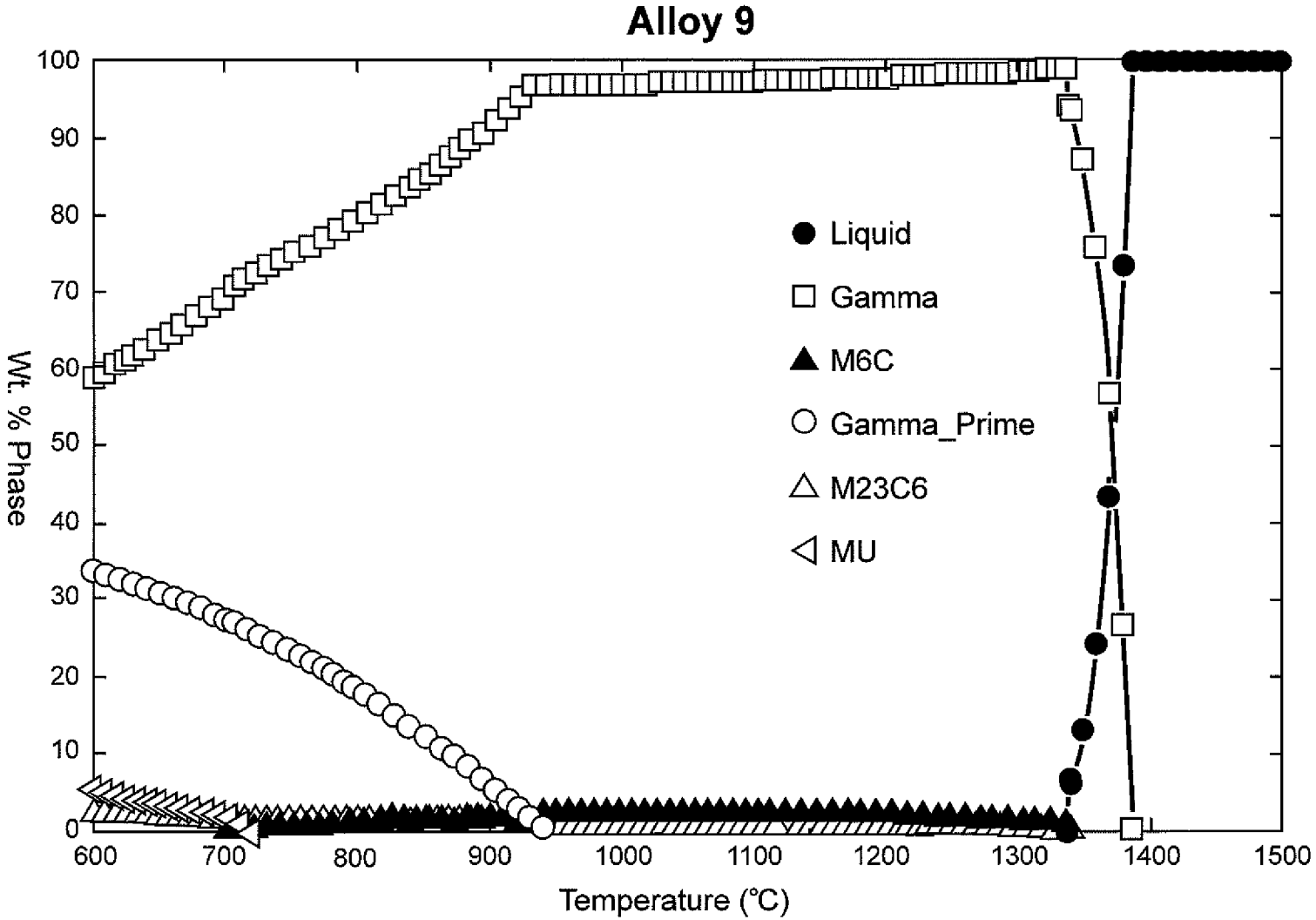
FIG. 9 is a graph showing phase equilibria for Alloy 9 as a function of temperature (nitrogen and boron are not included in the calculations).
Figure 10:
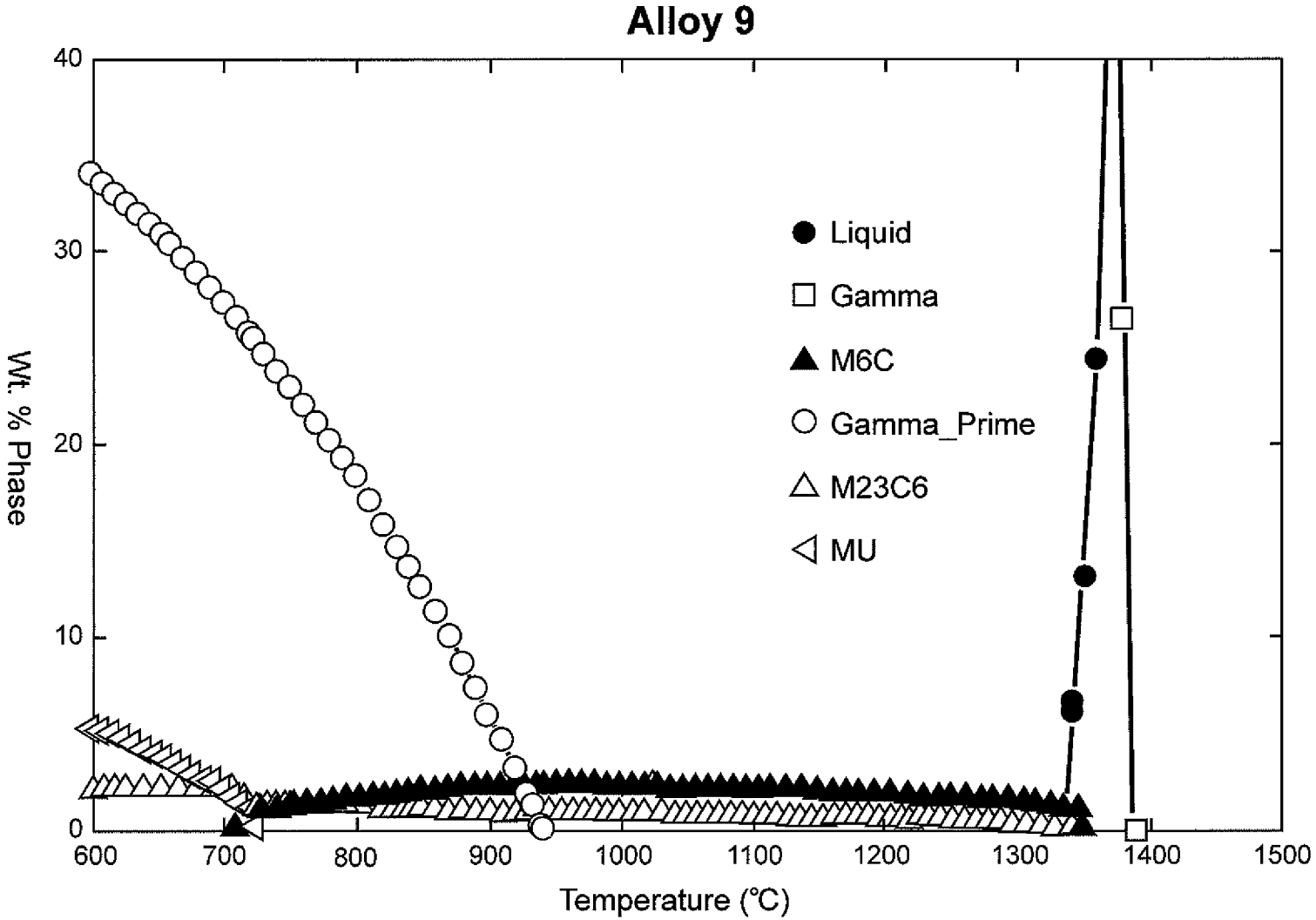
FIG. 10 is an expanded view of a portion of the graph shown in FIG. 9 to show details.
Figure 11:
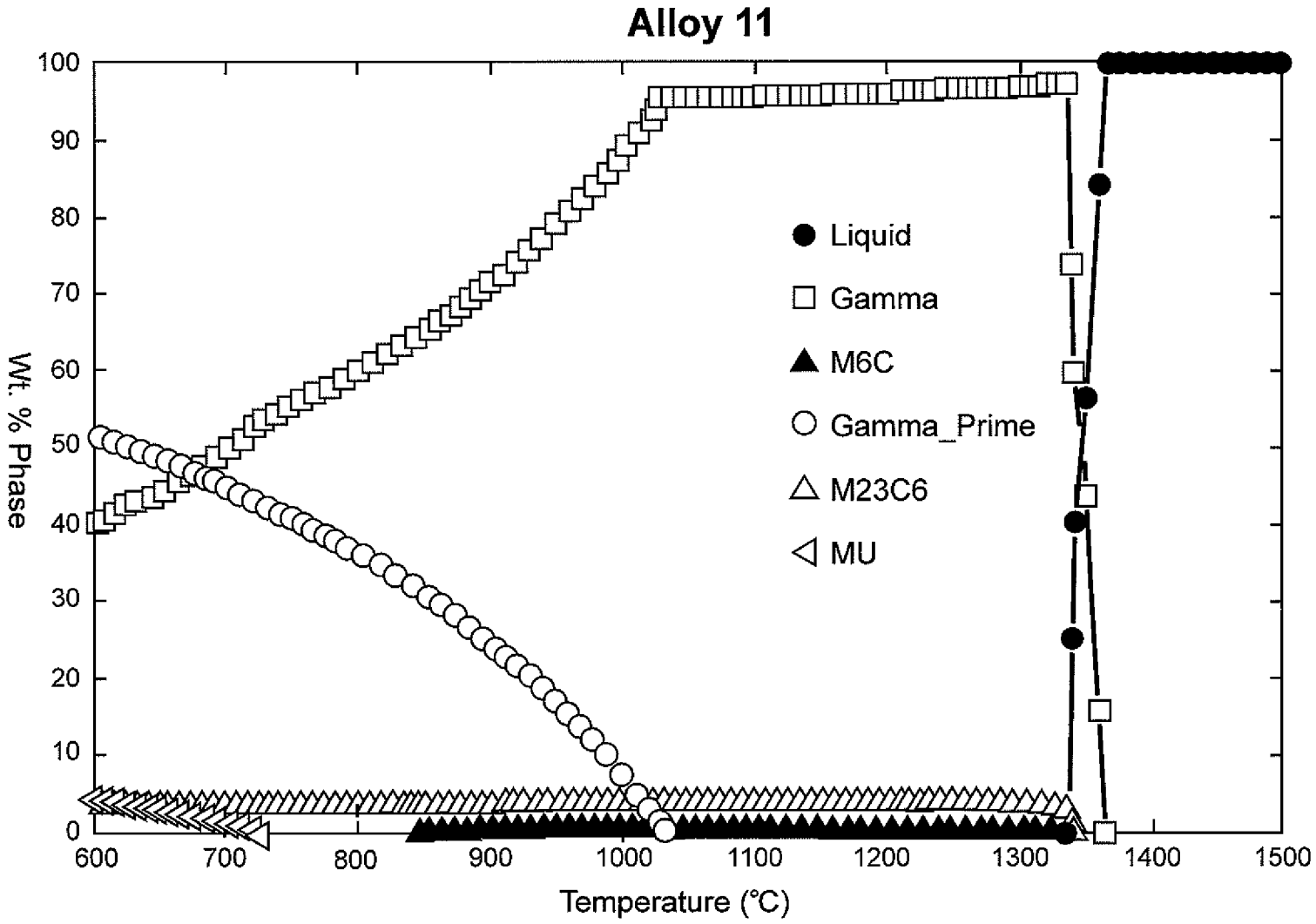
FIG. 11 is a graph showing phase equilibria for Alloy 11 as a function of temperature (nitrogen and boron are not included in the calculations).
Figure 12:
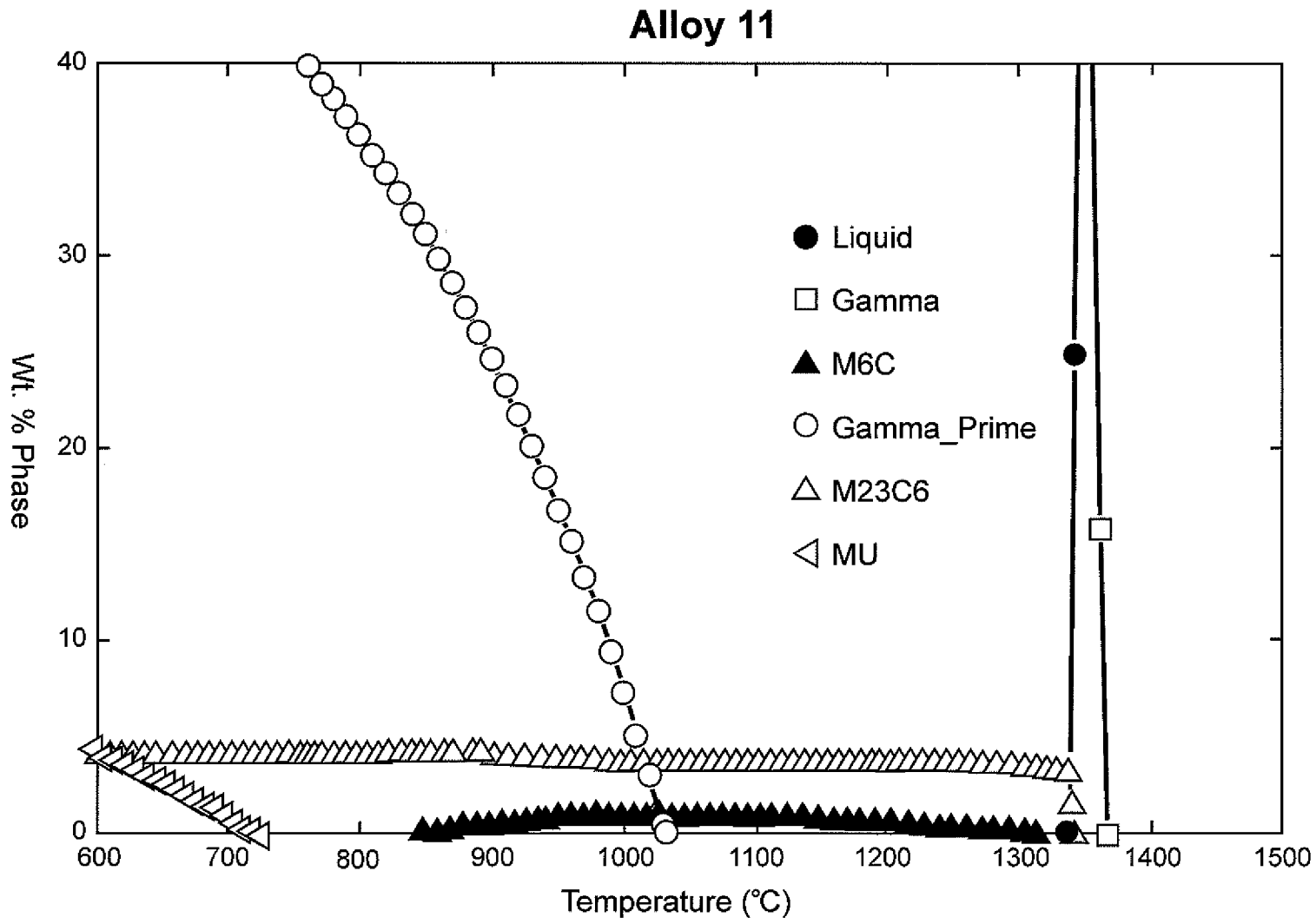
FIG. 12 is an expanded view of a portion of the graph shown in FIG. 11 to show details.
Figure 13:
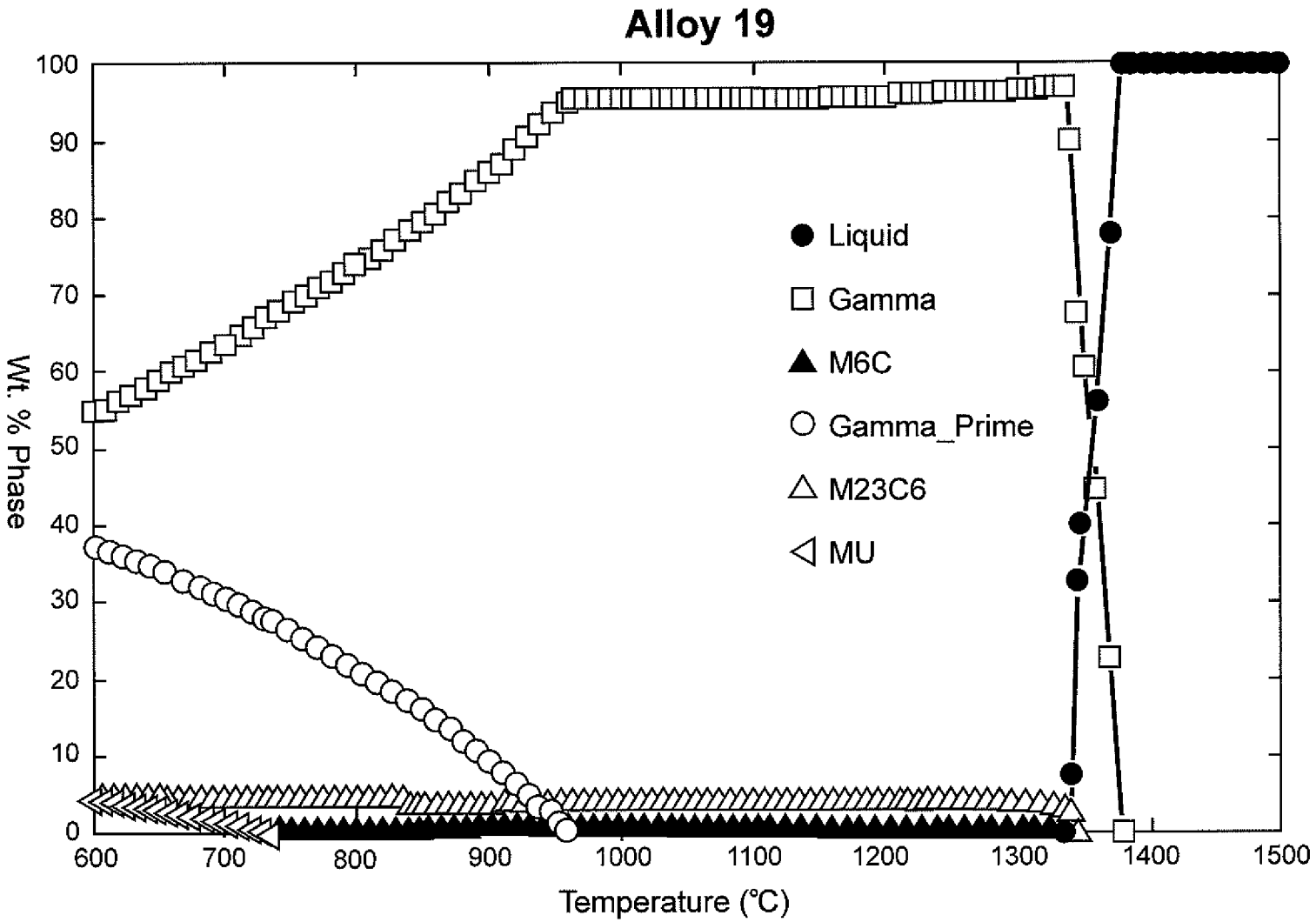
FIG. 13 is a graph showing phase equilibria for Alloy 19 as a function of temperature (nitrogen and boron are not included in the calculations).
Figure 14:
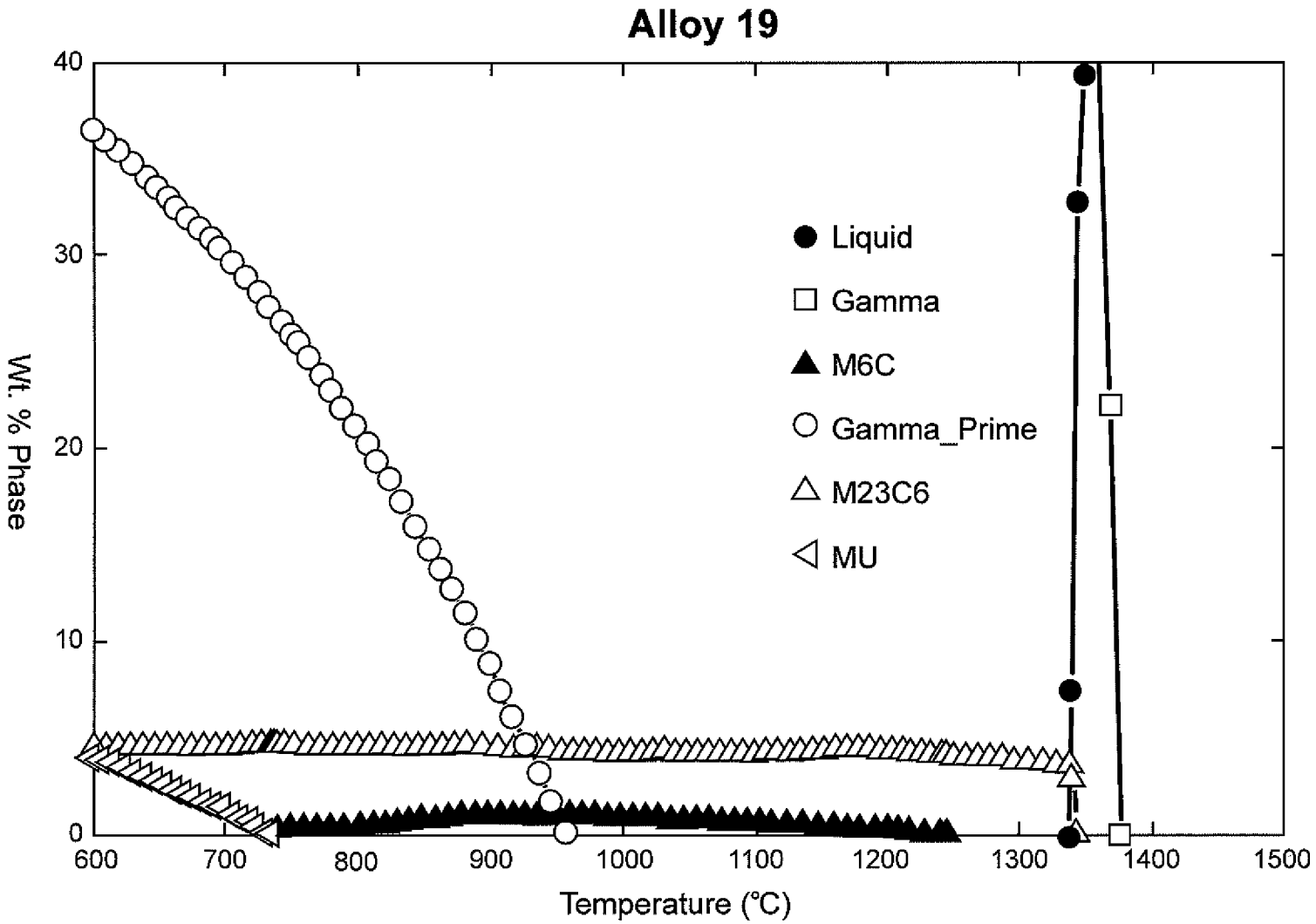
FIG. 14 is an expanded view of a portion of the graph shown in FIG. 13 to show details.
Figure 15:
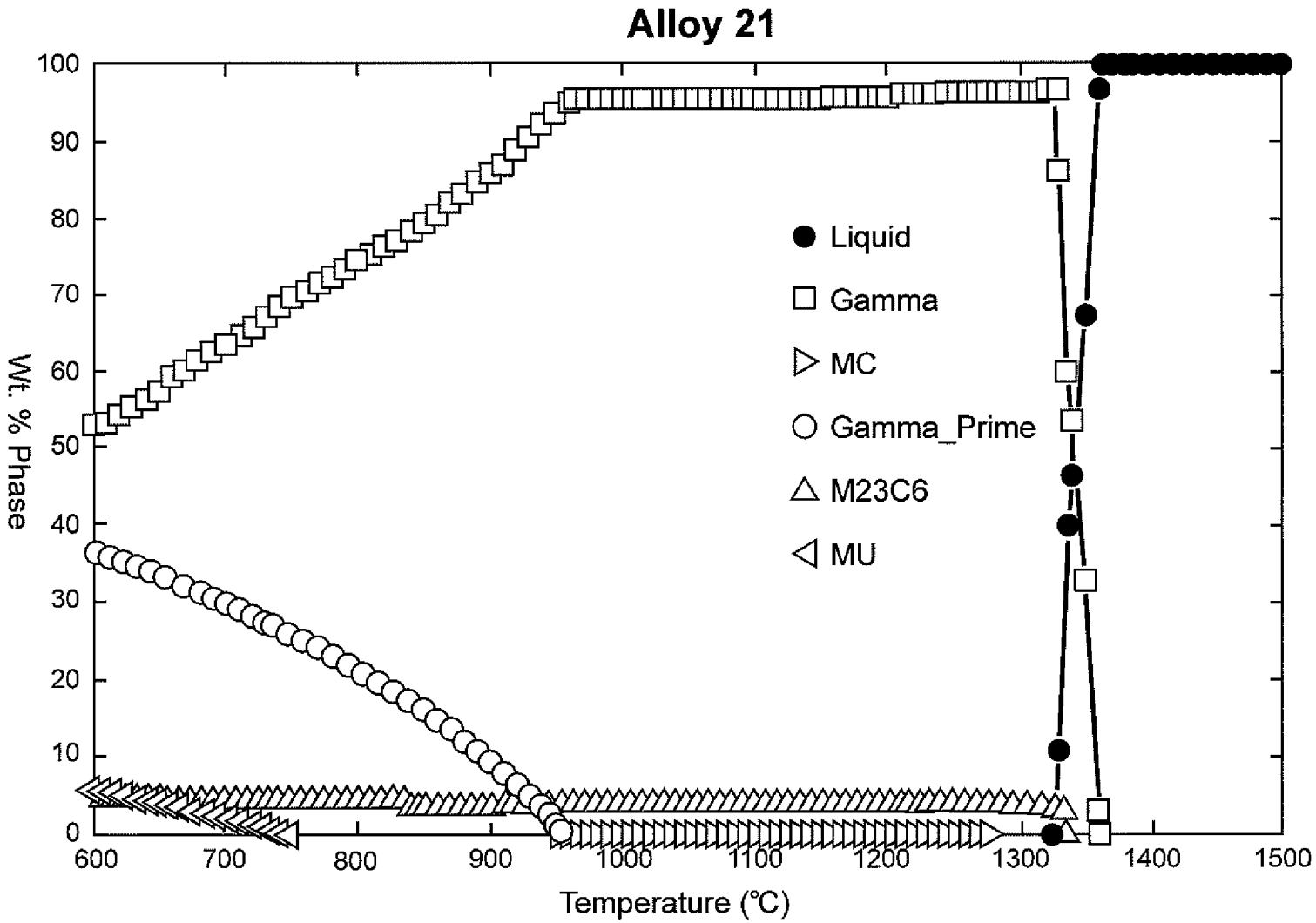
FIG. 15 is a graph showing phase equilibria for Alloy 21 as a function of temperature (nitrogen and boron are not included in the calculations).
Figure 16:
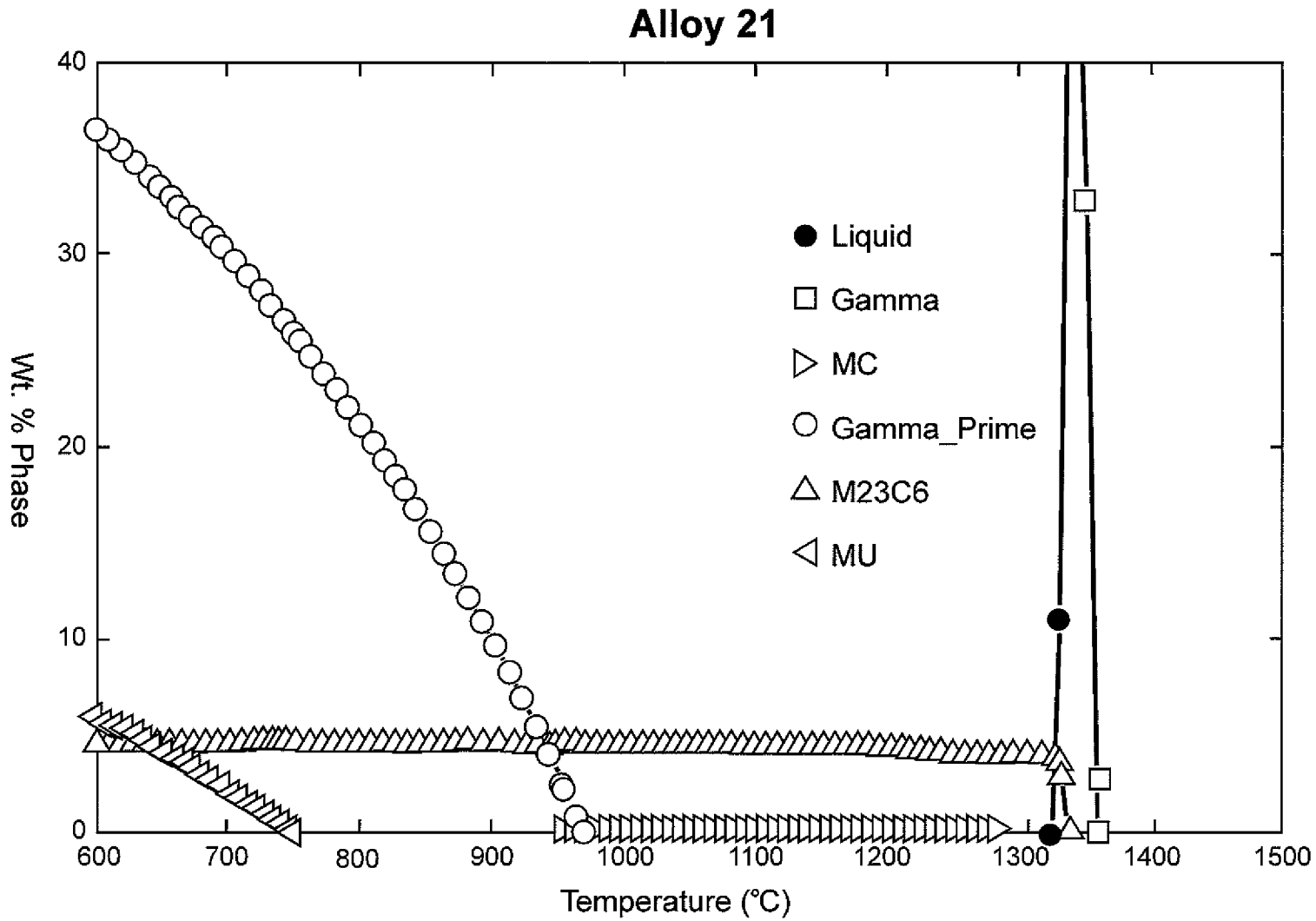
FIG. 16 is an expanded view of a portion of the graph shown in FIG. 15 to show details.
Figure 17:
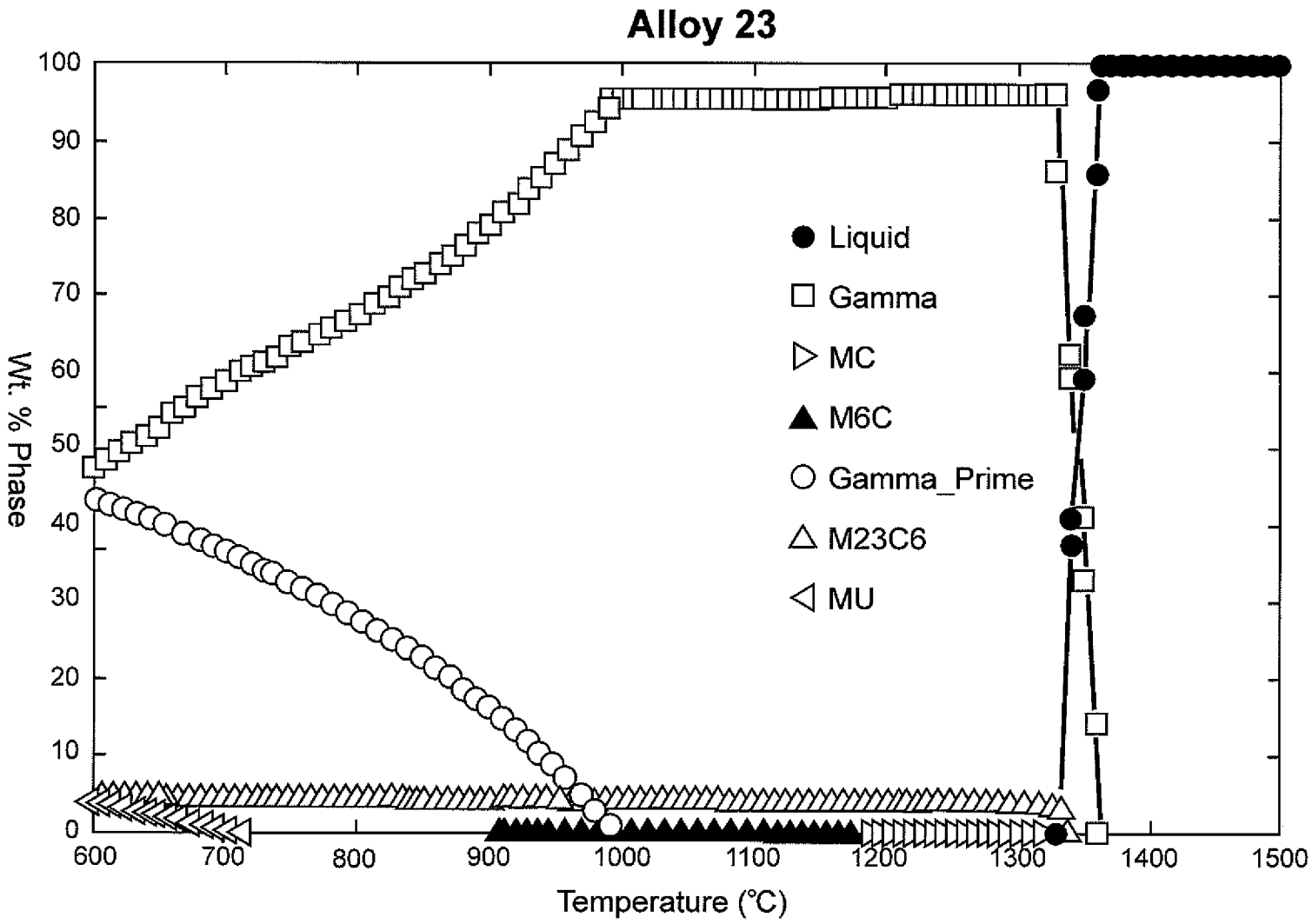
FIG. 17 is a graph showing phase equilibria for Alloy 23 as a function of temperature (nitrogen and boron are not included in the calculations).
Figure 18:
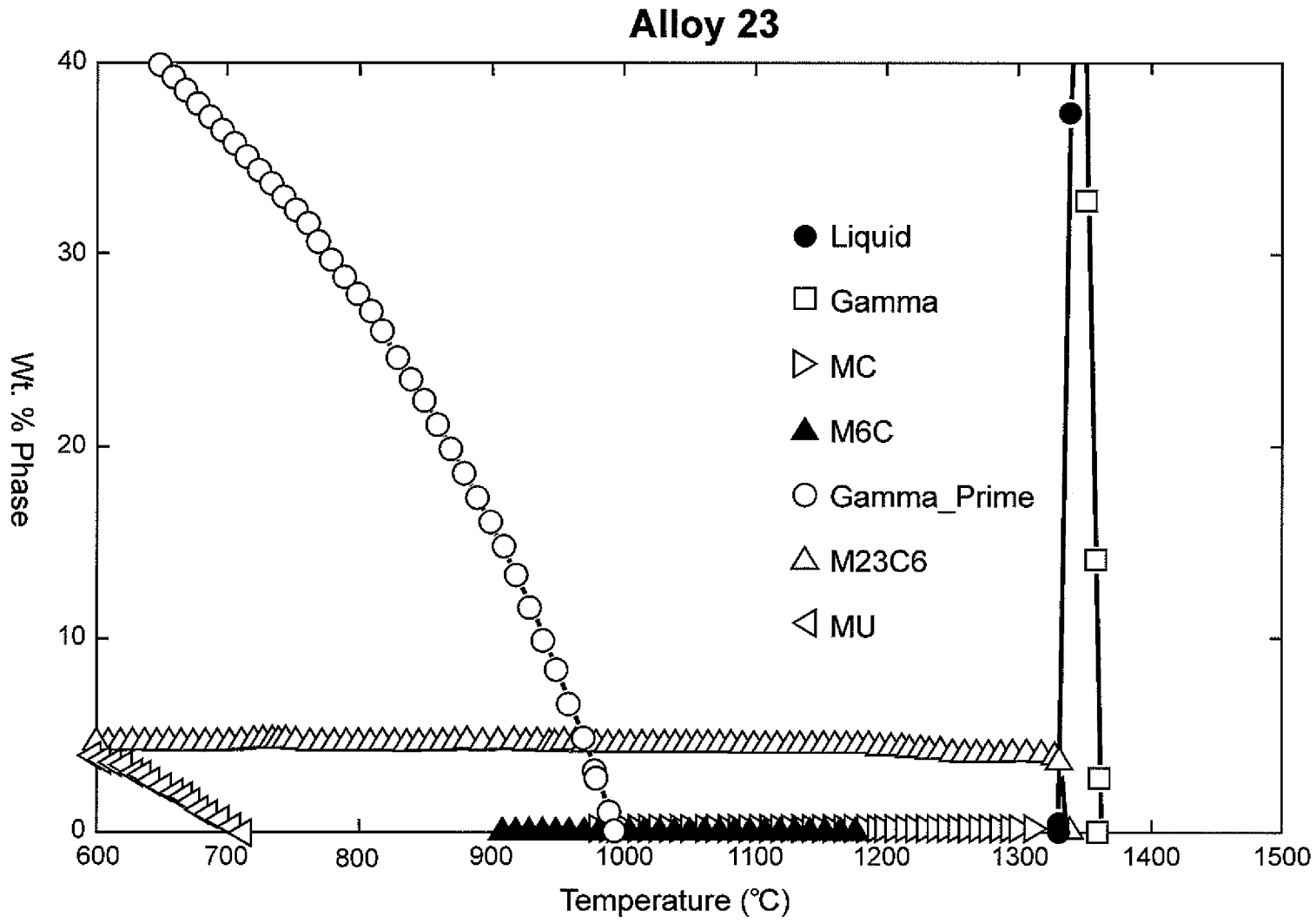
FIG. 18 is an expanded view of a portion of the graph shown in FIG. 17 to show details.

Further testing was carried out in 100-hour cycles at 1100° C. in wet air (10% $H_2O$); test results are shown in FIG. 2.

Creep life of some of the alloys that showed good oxidation resistance at higher temperatures was tested at 1093° C. under constant load conditions at an initial stress of 1 Ksi in air. Results are shown in Table 2. Further testing was done at 982° C. and 3 Ksi. Alloys 1, 4, and 6 are expected to perform adequately at lower temperatures, typically in the range of 850 to 950° C.

Table 3 shows yield strength of some of the alloys as a function of temperature.

Predictions of equilibrium phase fractions (in weight %) of various alloys at 900° C. are shown in Table 4. Predictions of equilibrium phase fractions (in weight %) of various alloys at 950° C. are shown in Table 5. Predictions of equilibrium phase fractions (in weight %) of various alloys at 1100° C. are shown in Table 6.

Tables 1, 2, 3, 4, 5, and 6 follow.

While there has been shown and described what are at present considered to be examples of the invention, it will be obvious to those skilled in the art that various changes and modifications can be prepared therein without departing from the scope of the inventions defined by the appended claims.

TABLE 1

Compositions of Alloys

| Alloy Sample | Ni | Fe | Al | Cr | Mn | Mo | Ti | Hf | La | W | C | B | N |
|---|---|---|---|---|---|---|---|---|---|---|---|---|---|
| Alloy 1 | 81.53 | 0.01 | 3.39 | 6.52 | 0.73 | 5.87 | 1.17 | 0 | 0.02 | 0.5 | 0.26 | 0 | 0.0018 |
| Alloy 4 | 76.85 | 0.01 | 3.42 | 11.64 | 0.69 | 5.87 | 0.74 | 0 | 0.03 | 0.5 | 0.25 | 0 | 0.002 |
| Alloy 6 | 70.96 | 1.93 | 3.42 | 15.8 | 0.73 | 5.89 | 0.5 | 0 | 0.03 | 0.49 | 0.25 | 0 | 0.0032 |
| Alloy 9 | 67.2097 | 5.84 | 3.42 | 15.87 | 0.72 | 5.85 | 0.48 | 0 | 0.02 | 0.49 | 0.1 | 0.0003 | 0.0039 |
| Alloy 11 | 69.66 | 1.99 | 4.54 | 15.96 | 0.73 | 5.92 | 0.49 | 0 | 0.02 | 0.48 | 0.21 | 0 | 0.0072 |
| Alloy 19 | 62.679 | 9.7 | 3.9 | 16.53 | 0.72 | 5.27 | 0.48 | 0 | 0.01 | 0.46 | 0.25 | 0.001 | 0.0118 |
| Alloy 21 | 66.59 | 1.93 | 3.42 | 19.51 | 0.71 | 6.52 | 0.49 | 0.08 | 0.02 | 0.49 | 0.24 | 0 | 0.0061 |
| Alloy 23 | 68.63 | 1.95 | 3.92 | 17.47 | 0.7 | 6.06 | 0.47 | 0.08 | 0.02 | 0.46 | 0.24 | 0 | 0.0034 |

TABLE 2

Creep Test Results

| Alloy Sample | Temperature (° C.) | Stress (Ksi) | Creep life (Hours) |
|---|---|---|---|
| Haynes 230 (for comparison) | 1093 | 1 | 1000 |
| Alloy 9 | 1093 | 1 | 755.4 |
| Alloy 11 | 1093 | 1 | 975.2 |
| Alloy 19 | 1093 | 1 | 593.6 |
| Alloy 21 | 1093 | 1 | 1094.9 |
| Alloy 23 | 1093 | 1 | 751.5 |
| Alloy 19 | 982 | 3 | 460.0 |
| Alloy 21 | 982 | 3 | 664.5 |
| Alloy 23 | 982 | 3 | 166.7 |

TABLE 3

Yield Strength Results

| Alloy Sample | Room Temperature (Ksi) | 882° C. (Ksi) | 960° C. (Ksi) |
|---|---|---|---|
| 1 | 83 | 55 | >20 |
| 4 | 96 | 63 | >20 |
| 11 | 139 | 86 | >37 |
| 19 | 94 | 61 | >19 |
| 21 | 130 | 84 | >34 |
| 23 | 91 | 67 | >16 |

TABLE 4

Equilibrium Phase Fractions at 900° C.

| Alloy Sample | Wt. % γ | Wt. % $M_{23}C_6$ | Wt. % $M_6C$ | Wt. % γ' |
|---|---|---|---|---|
| 1 | 84.43 | 3.14 | 3.80 | 8.63 |
| 4 | 83.00 | 3.53 | 2.64 | 10.83 |
| 6 | 84.85 | 4.24 | 1.27 | 9.64 |
| 9 | 91.01 | 2.23 | 0.77 | 5.99 |
| 11 | 71.16 | 3.89 | 0.43 | 24.52 |
| 19 | 85.67 | 4.39 | 0.97 | 8.97 |
| 21 | 85.86 | 4.69 | 0 | 9.44 |
| 23 | 79.31 | 4.70 | 0 | 15.99 |

TABLE 5

Equilibrium Phase Fractions at 950° C.

| Alloy Sample | Wt. % γ | Wt. % $M_{23}C_6$ | Wt. % $M_6C$ | Wt. % γ' |
|---|---|---|---|---|
| 1 | 91.11 | 3.21 | 3.53 | 2.15 |
| 4 | 90.29 | 3.56 | 2.52 | 3.63 |

TABLE 5-continued

Equilibrium Phase Fractions at 950° C.

| Alloy Sample | Wt. % γ | Wt. % $M_{23}C_6$ | Wt. % $M_6C$ | Wt. % γ' |
|---|---|---|---|---|
| 6 | 92.49 | 4.22 | 1.28 | 2.01 |
| 9 | 96.98 | 2.30 | 0.71 | 0 |
| 11 | 78.77 | 3.73 | 0.73 | 16.78 |
| 19 | 93.26 | 4.37 | 0.99 | 1.38 |
| 21 | 92.95 | 4.69 | 0 | 2.36 |
| 23 | 86.90 | 4.60 | 0.19 | 8.32 |

TABLE 6

Equilibrium Phase Fractions at 1100° C.

| Alloy Sample | Wt. % γ | Wt. % $M_{23}C_6$ | Wt. % $M_6C$ | Wt. % γ' |
|---|---|---|---|---|
| 1 | 94.58 | 3.73 | 1.69 | 0 |
| 4 | 94.79 | 3.94 | 1.27 | 0 |
| 6 | 94.93 | 4.34 | 0.72 | 0 |
| 9 | 97.23 | 2.17 | 0.61 | 0 |
| 11 | 95.60 | 3.59 | 0.81 | 0 |
| 19 | 94.92 | 4.43 | 0.65 | 0 |
| 21 | 95.42 | 4.57 | 0.01 | 0 |
| 23 | 95.32 | 4.48 | 0.01 | 0.18 |

What is claimed is:

1. An alloy consisting essentially of, in weight percent:

Fe 0.01 to 10

Al 3.3 to 4.6

Cr 6 to 22

Mn 0.68 to 0.74

Mo 5.2 to 6.6

Ti 0.4 to 1.2

Hf up to 0.1

La 0.005 to 0.05

W 0.4 to 0.6

C greater than 0.1 to 0.35

B up to 0.002

N 0.001 to 0.02

Ni balance, wherein the alloy has Al+Cr from 9.3 to 26.6, and wherein a specimen mass change ($mg/cm^2$) after 200 1-hr cycles at 1150° C. in wet air (10% $H_2O$) is no less than −1, and no more than +1.

2. The alloy of claim 1, wherein Fe is present in an amount of 1 to 6 weight percent.

3. The alloy of claim 1, wherein Cr is present in an amount of 11.64 to 22 weight percent.

4. The alloy of claim 1, wherein Fe is present in an amount from 1.93 to 10.

5. The alloy of claim 1, wherein Al+Cr is present in an amount from 15.06 to 26.6.

6. The alloy of claim 1, wherein Al+Cr is present in an amount from 19.22 to 26.6.

7. The alloy of claim 1, wherein Fe is present in an amount from 5.84 to 10.

8. The alloy of claim 1, wherein the alloy has a yield strength of at least 83 Ksi at room temperature and at least 55 Ksi at 882° C.

9. The alloy of claim 1, wherein the alloy has a creep rupture life of at least 593.6 hrs at 1093° C. and a stress of 1 Ksi.

10. The alloy of claim 1, wherein the alloy has a creep rupture life of at least 166.7 hrs. at 982° C. and a stress of 3 Ksi.

11. The alloy of claim 1, wherein $M_{23}C_6$ is present from 2.23 to 4.7 wt. % at 900° C.

12. The alloy of claim 1, wherein $M_6C$ is present from 0 to 3.8 wt. % at 900° C.

13. The alloy of claim 1, wherein $M_{23}C_6$ is present from 2.17 to 4.57 wt. % at 1100° C.

14. The alloy of claim 1, wherein $M_6C$ is present from 0.01 to 1.69 wt. % at 1100° C.

15. The alloy of claim 1, wherein γ' is present from 5.99 to 24.52 wt. % at 900° C.

16. The alloy of claim 1, wherein γ' is present from 0 to 16.78 wt. % at 950° C.

17. The alloy of claim 1, wherein the total carbide content is from 4.69 to 6.94 wt. % at 900° C.

18. The alloy of claim 1, wherein the total carbide content is from 3.01 to 6.74 wt. % at 950° C.

19. The alloy of claim 1, wherein the total carbide content is from 4.49 to 5.42 wt. % at 1100° C.

* * * * *